US006172002B1

(12) United States Patent
Saito et al.

(10) Patent No.: US 6,172,002 B1
(45) Date of Patent: Jan. 9, 2001

(54) TRANSFER-TYPE LAMINATE FILM FOR IMAGE PROTECTION, AND THERMAL TRANSFER INK SHEET

(75) Inventors: Kenichi Saito; Motohiro Mizumachi, both of Miyagi (JP)

(73) Assignee: Sony Corporation, Tokyo (JP)

( * ) Notice: Under 35 U.S.C. 154(b), the term of this patent shall be extended for 0 days.

(21) Appl. No.: 09/313,174

(22) Filed: May 18, 1999

(30) Foreign Application Priority Data

May 22, 1998 (JP) ..... 10-141249

(51) Int. Cl.[7] ..... B41M 5/20

(52) U.S. Cl. ..... 503/227; 428/346; 428/352; 428/354; 428/913; 428/914

(58) Field of Search ..... 428/195, 343, 428/346, 352, 354, 913, 914; 8/471; 503/227

(56) References Cited

U.S. PATENT DOCUMENTS 5,096,876 * 3/1992 Jahn et al. ..... 503/227

* cited by examiner

*Primary Examiner*—Bruce H. Hess
(74) *Attorney, Agent, or Firm*—Sonnenschein, Nath & Rosenthal

(57) ABSTRACT

A transfer-type laminate film is disclosed, comprising a thermal transfer laminate layer for image protection as formed on a substrate, wherein the thermal transfer laminate layer contains an ultraviolet absorbent that is liquid at ordinary temperature.

8 Claims, 2 Drawing Sheets

TRANSFER-TYPE LAMINATE FILM FOR IMAGE PROTECTION, AND THERMAL TRANSFER INK SHEET

BACKGROUND OF THE INVENTION

1. Field of the Invention

The present invention relates to a transfer-type laminate film applicable to a sublimation-type thermal transfer recording system, in which an image is printed on a printing article via a thermal head and a transparent, image-protecting resin film (this is the thermal transfer laminate layer of the laminate film) is transferred under heat onto the printed surface of the article from the laminate film, and also to a thermal transfer ink sheet combined with the transfer-type laminate film.

2. Description of the Related Art

The recent tendency in the art is toward a sublimation-type thermal transfer recording system that enables expression of images with continuous full-color gradation, as the technique for hard copies of image signals.

In the sublimation-type thermal transfer recording system, a transparent film for image protection is laminated over the image as formed on printing paper for the purpose of, for example, protecting the image surface, preventing the image from being discolored or faded, and making the image surface resistant to sebum. One example of the laminate film to be used for those purposes is a transfer-type laminate film for image protection, which comprises a substrate and a thermal transfer laminate layer of a thermoplastic resin formed on the substrate.

A method for laminating such a transfer-type laminate film for image protection over images comprises placing the laminate layer of the film on the image formed on printing paper, and heating it under pressure in accordance with the image information, whereby the part of the laminate layer having been heated under pressure is transferred onto the printing paper. Using the transfer-type laminate film of that type makes the printed images have good resistance to hand-stained sebum and good resistance to plasticizers that may be in polyvinyl chloride products such as wallpaper, floor mats, tablecloths, etc.

Known is a thermal transfer ink sheet which comprises an ink layer containing a subliming dye for image formation and formed on a substrate. A technique of incorporating a transfer-type laminate film into the thermal transfer ink sheet of that type has been proposed, in which an additional thermal transfer laminate layer is formed on the substrate of the thermal transfer ink sheet, apart from the ink layer formed thereon. According to that technique, it is easy to continuously transfer the thermal transfer laminate layer onto the printed images in the printer using the ink sheet, and, in addition, the surface of the printed images is not directly contacted with sebum and plasticizers. Therefore, the technique enables ideal image protection.

The dye images formed on printing paper are discolored and faded by the action of ultraviolet rays in natural light or fluorescent lamps, etc., and are therefore problematic in that their resistance to light is not good. To solve this problem, tried is adding an ultraviolet absorbent that is solid at ordinary temperature to the thermal transfer laminate layer for the purpose of preventing ultraviolet rays causing the problem from reaching the dye images to thereby increase the resistance of the images to light.

However, adding an ultraviolet absorbent that is solid at ordinary temperature to the thermal transfer laminate layer is problematic in that, after the laminate layer containing the ultraviolet absorbent is transferred onto images, the ultraviolet absorbent gradually crystallizes and precipitates in the image surface to thereby significantly degrade the quality of the images. This problem is especially remarkable when the thermal transfer laminate layer contains a relatively large amount of such an ultraviolet absorbent.

SUMMARY OF THE INVENTION

The present invention is to solve the problems in the related art noted above, and its object is to prevent the image quality from being degraded by the precipitation of an ultraviolet absorbent even when a large amount of an ultraviolet absorbent is added to the thermal transfer laminate layer for the purpose of increasing the resistance to light of the images formed on printing paper.

We, the present inventors have found that adding an ultraviolet absorbent which is liquid at ordinary temperature to the thermal transfer laminate layer of a transfer-type laminate film could attain the object noted above, and, on the basis of this finding, we have completed the invention.

Specifically, the invention provides a transfer-type laminate film comprising a thermal transfer laminate layer for image protection as formed on a substrate, wherein the thermal transfer laminate layer contains an ultraviolet absorbent that is liquid at ordinary temperature.

The invention also provides a thermal transfer ink sheet comprising a subliming dye-containing ink layer and a thermal transfer laminate layer for image protection as formed on one and the same surface of a substrate, wherein the thermal transfer laminate layer contains an ultraviolet absorbent that is liquid at ordinary temperature.

DETAILED DESCRIPTION OF THE INVENTION

The invention is described in detail with reference to the drawings attached hereto.

FIG. 1 to FIG. 4 are cross-sectional views of different embodiments of the transfer-type laminate film of the invention.

Figure 1:
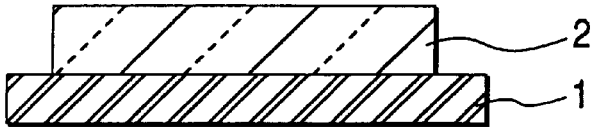
FIG. 1 is a cross-sectional view of one embodiment of the transfer-type laminate film of the invention.

FIG. 1 is a cross-sectional view of one embodiment of the transfer-type laminate film of the invention, in which a single-layered, thermal transfer laminate layer 2 consisting essentially of a thermoplastic resin is formed on a substrate 1. The ultraviolet absorbent to be added to the thermal transfer laminate layer 2 shall be liquid at ordinary temperature. Adding such an ultraviolet absorbent which is liquid at ordinary temperature to the layer 2, the resistance to light of the images formed on printing paper and covered with the layer 2 is increased. Therefore, in the invention, even when a relatively large amount of such an ultraviolet absorbent is added to the thermal transfer laminate layer, the ultraviolet absorbent does not precipitate in the printed images and does not degrade the image quality.

The ultraviolet absorbent to be used in the invention may be any and every one that is liquid at ordinary temperature. The terminology "ordinary temperature" referred to herein is meant to indicate the temperature range within which transfer-type laminate films are stored in ordinary application modes, and, in general, it may range between −5° C. and 40° C. The terminology "liquid" as referred to herein is meant to indicate that the ultraviolet absorbent has fluidity and does not crystallize at ordinary temperature. For their fluidity, in general, liquid ultraviolet absorbents will have a viscosity falling between 5,000 and 20,000 cps (at 25° C.). Within the viscosity range, ultraviolet absorbents having a higher viscosity are preferred for use in the invention.

As specific examples of the ultraviolet absorbent of that type, mentioned are Seesorb 702L (a trade name, from Shipro Kasei), Tinuvin213 (a trade name, from Ciba-Geigy, Japan), etc.

The single-layered, thermal transfer laminate layer 2 in FIG. 1 is transferred under heat onto image-printed paper to protect the images on the paper, and this consists essentially of a thermoplastic resin. Preferably, the thermoplastic resin for that purpose could well adhere onto image-printed paper under hot pressure, and includes, for example, cellulose acetate butyrate resins, vinyl chloride-vinyl acetate copolymers, polyvinyl butyral resins, polyester resins, etc.

The thickness of the single-layered, thermal transfer laminate layer 2 may be suitably determined, depending on the type of the thermoplastic resin that forms the layer, the intended degree of adhering force of the layer, the degree of edge sharpness (tailing) of the transferred layer, etc. In general, however, it is desirable that the layer has a thickness of from 1 to 10 μm or so, in view of its transferability onto printing paper.

In the transfer-type laminate film of FIG. 1, the thermal transfer laminate layer 2 has a single-layered structure. Apart from this, the thermal transfer laminate layer 2 may be composed a release layer 2*a* and an adhesive layer 2*b* which are formed in that order on the substrate 1, as in FIG. 2; or may be composed of an adhesive layer 2*b* and a re-transfer preventing layer 2*c* which are formed in that order on the substrate 1, as in FIG. 3; or may be composed of a release layer 2*a,* an adhesive layer 2*b* and a re-transfer preventing layer 2*c* which are formed in that order on the substrate 1, as in FIG. 4.

Figure 2:
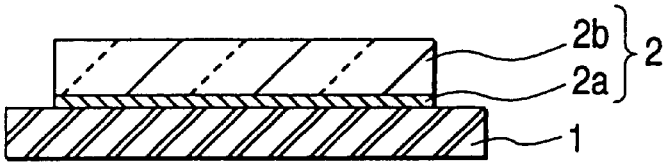
FIG. 2 is a cross-sectional view of another embodiment of the transfer-type laminate film of the invention.

In the embodiment of FIG. 2, the ultraviolet absorbent that is liquid at normal temperature may be in both the release layer 2*a* and the adhesive layer 2*b,* or in either one of them. Where it is in the two layers, its concentration in the two may be the same or different.

Figure 3:
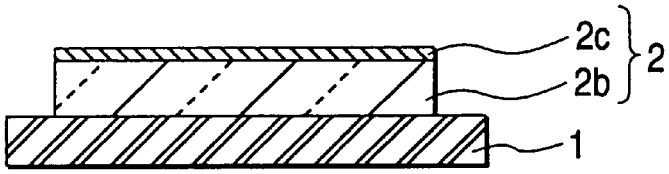
FIG. 3 is a cross-sectional view of still another embodiment of the transfer-type laminate film of the invention.

In the embodiment of FIG. 3, the ultraviolet absorbent that is liquid at normal temperature may be in both the adhesive layer 2*b* and the re-transfer preventing layer 2*c*, or in either one of them. Where it is in the two layers, its concentration in the two may be the same or different.

Figure 4:
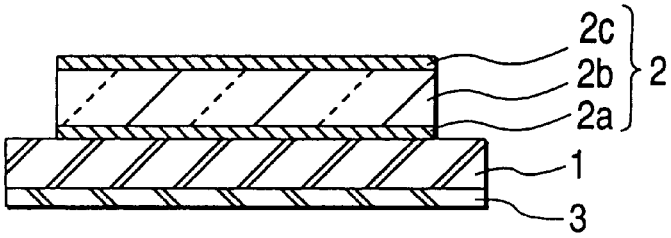
FIG. 4 is a cross-sectional view of still another embodiment of the transfer-type laminate film of the invention.

In the embodiment of FIG. 4, the ultraviolet absorbent that is liquid at normal temperature may be in all the release layer 2*a*, the adhesive layer 2*b* and the re-transfer preventing layer 2*c*, or in any one or two of them. Where it is in all those layers or in two of those layers, its concentration in the layers may be the same or different.

The release layer 2*a* is to ensure and facilitate smooth release of the thermal transfer laminate layer 2 from the substrate 1 in thermal transfer operation, and this may be any known release layer generally employed in known transfer-type laminate films. For example, it may be made of a thermoplastic resin such as polyurethane, cellulose acetate butyrate or the like that contains a releasing agent of a release filler, a silicone resin or the like.

The thickness of the release layer 2*a* is not specifically defined, but, in general, it preferably falls between 0.1 and 1 μm or so.

The adhesive layer 2*b* consists essentially of a thermoplastic resin which may be the same as that for the single-layered, thermal transfer laminate layer 2 in the thermal transfer-type laminate film of FIG. 1. It is desirable that the thermoplastic resin for the adhesive layer 2*b* well adheres onto image-printed paper under hot pressure. Preferred examples of the resin are cellulose acetate butyrate resins, vinyl chloride-vinyl acetate copolymers, polyvinyl butyral resins, polyester resins, etc.

The thickness of the adhesive layer 2*b* may be suitably determined, depending on the type of the thermoplastic resin that forms the layer, the intended degree of adhering force of the layer, the degree of edge sharpness (tailing) of the transferred layer, etc. In general, however, it is desirable that the layer 2*b* has a thickness of from 1 to 5 μm or so, in view of its transferability onto printing paper.

The re-transfer preventing layer 2*c* is to prevent migration of dye into the thermal transfer laminate layer 2. When the transfer-type laminate film is incorporated into a thermal transfer ink sheet (see FIG. 5), as will be described in detail hereinunder, the thermal transfer laminate layer 2 may be contacted with the ink layer 4 while the sheet is stored. In that case, the dye existing in the ink layer 4 will migrate into the thermal transfer laminate layer 2, but the re-transfer preventing layer 2*c* prevents the dye migration into the layer 2. In order that the adhesive layer 2*b* of the thermal transfer laminate layer 2 could be contacted with printing paper in thermal transfer operation, the re-transfer preventing layer 2*c* must be uniformly mixed with the adhesive layer 2*b* in thermal transfer operation.

It is desirable that the re-transfer preventing layer 2*c* is made of a resin into which the dye in the ink layer 4 could hardly migrate and which is well miscible with the adhesive layer 2*b* . The resin includes, for example, acrylic resins, polystyrene resins, etc.

The thickness of the re-transfer preventing layer 2*c* may be suitably determined, depending on the type of the thermoplastic resin that forms the neighboring adhesive layer 2*b,* the intended degree of adhering force of the adhesive layer 2*b,* the re-transfer preventing ability of the layer 2*c*, etc. In general, however, it is desirable that the layer 2*c* has a thickness of from 0.3 to 1 μm or so.

The amount of the ultraviolet absorbent which is liquid at ordinary temperature and which is in the thermal transfer laminate layer 2 shall be basically so defined that it does not interfere with the function of the layer 2. More concretely, irrespective of the type of the thermal transfer laminate layer 2 as to whether the layer 2 is of a single-layered type as in FIG. 1 or of a multi-layered type as in FIG. 2 to FIG. 4, it is desirable that the amount of the ultraviolet absorbent in the layer 2 is from 5 to 20 parts by weight relative to 100 parts by weight of all the thermoplastic resin constituting the thermal transfer laminate layer 2. If the amount of the ultraviolet absorbent to be in the layer 2 is too small, the resistance to light of the protected images will be poor; but if too large, the surface of the layer 2 will be too sticky.

The substrate 1 for the transfer-type laminate film of the invention is not specifically defined, provided that its resistance to heat is satisfactory to such a degree that it could retain the shape of film at heat transfer temperatures. For example, the substrate 1 is of a polyester film, a polyimide film or the like.

The back surface of the substrate 1 (that is opposite to the surface thereof coated with the heat transfer laminate layer 2) may be processed to have heat-resistant lubricity or may be coated with a heat-resistant lubricative layer 3 (see FIG. 4). While the thermal transfer laminate layer 2 on the substrate 1, of which the back surface has been thus lubricated, is transferred under heat onto image-printed paper, the substrate 1 is prevented from being fused on the thermal head, whereby smooth running of the transfer-type laminate film is ensured. The heat-resistant lubricative layer 3 may be made of a resin having a high softening point such as cellulose acetate, epoxy resin or the like. If desired, a lubricant of, for example, silicone oil, wax, fatty acid amides, phosphates and others may be added to or coated over the heat-resistant lubricative layer 3, and a filler may be added thereto.

The thickness of the substrate 1 is not specifically defined, but, in general, it preferably falls between 3 and 20 $\mu$m or so.

Regarding its surface smoothness, the substrate 1 may be optionally matted, or may be patterned in any desired manner, or may be smoothed.

Figure 5:
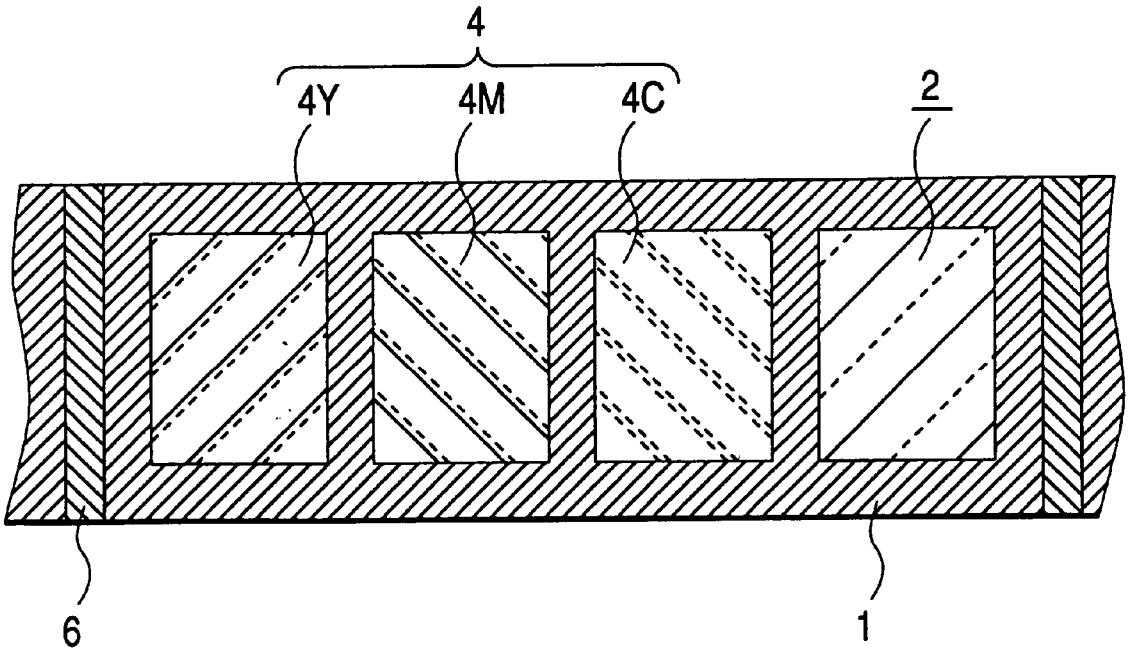
FIG. 5 is a plan view of a thermal transfer ink sheet as combined with the transfer-type laminate film of the invention.

The transfer-type laminate film of the invention may be used independently by itself, but is preferably incorporated into a thermal transfer ink sheet, as in FIG. 5, in which a thermal transfer laminate layer 10 is provided on one and the same substrate 1 along with an ink layer 4 (yellow ink layer 4Y, magenta ink layer 4M, cyan ink layer 4C) and a sensor mark 5 for detecting the sheet position. Having been formed on the thermal transfer ink sheet illustrated, the thermal transfer laminate layer 10 could be easily and directly transferred onto the printed images in the printer using the sheet. In addition, the surface of the printed images is not directly contacted with sebum and plasticizers, while as yet not coated with the layer 10 for image protection. Therefore, the transfer-type laminate film as incorporated into the thermal transfer ink sheet enables ideal image protection.

In the embodiment of FIG. 5, the ink layer 4 is composed of an yellow ink layer 4Y, a magenta ink layer 4M and a cyan ink layer 4C as formed on the surface of one and the same substrate in that order, which, however, is not limitative. If desired, an additional ink layer of black ink or the like may be further provided on the surface of the substrate, or only one ink layer of any desired color may be formed on the substrate.

The ink layer 4 may comprise a known subliming dye as dispersed or dissolved in a known thermoplastic resin. The thermoplastic resin for the ink layer 4 includes, for example, cellulose resins such as methyl cellulose, ethyl cellulose, hydroxyethyl cellulose, hydroxypropyl cellulose, cellulose acetate, etc.; polyvinyl resins such as polyvinyl alcohol, polyvinyl butyral, polyvinyl acetacetal, polyvinyl acetate, polystyrene, etc.; various urethane resins, etc.

As the dyes to be in the ink layer 4, for example, yellow dyes include azo dyes, disazo dyes, methine dyes, styryl dyes, pyridone-azo dyes, and their mixed dyes; magenta dyes include azo dyes, anthraquinone dyes, styryl dyes, heterocyclic azo dyes, and their mixed dyes; and cyan dyes include anthraquinone dyes, naphthoquinone dyes, heterocyclic azo dyes, indaniline dyes, and their mixed dyes.

As has been mentioned hereinabove, the advantage of the transfer-type laminate film of the invention is that the ultraviolet absorbent existing in the film does not crystallize in the surface of the film as transferred onto printed images to degrade the image quality. Therefore, the images formed through sublimation-type thermal transfer printing and coated with the transfer-type laminate film of the invention could have greatly improved resistance to light.

The invention is described more concretely with reference to the following Examples.

EXAMPLES 1 TO 4, AND COMPARATIVE EXAMPLES 1 TO 2

Formation of Transfer-Type Laminate Films

As in Table 1, a release layer composition for constituting a thermal transfer laminate layer was applied onto one surface of a polyester film substrate (Lumirror, from Toray) having a thickness of 6 $\mu$m, in an amount to give a dry thickness of 3 $\mu$m, and dried (at 120° C. for 1 minute) thereby forming thereon a release layer of the thermal transfer laminate layer.

TABLE 1

| | Constituent Components | Amount (wt. pts.) |
|---|---|---|
| Example 1 | CAB-551-0.2 (from Eastman Chemical)*1 | 9.0 |
| | Seesorb 702L (from Shiprokasei)*2 | 1.0 |
| | Methyl Ethyl Ketone | 40.0 |
| | Toluene | 40.0 |
| Example 2 | CAB-551-0.2 (from Eastman Chemical) | 8.0 |
| | Seesorb 702L (from Shiprokasei) | 2.0 |
| | Methyl Ethyl Ketone | 40.0 |
| | Toluene | 40.0 |
| Example 3 | CAB-551-0.2 (from Eastman Chemical) | 9.0 |
| | Tinuvin 213 (from Ciba-Geigy Japan)*3 | 1.0 |
| | Methyl Ethyl Ketone | 40.0 |
| | Toluene | 40.0 |
| Example 4 | CAB-551-0.2 (from Eastman Chemical) | 8.0 |
| | Tinuvin 213 (from Ciba-Geigy Japan) | 2.0 |
| | Methyl Ethyl Ketone | 40.0 |
| | Toluene | 40.0 |
| Comparative Example 1 | CAB-551-0.2 (from Eastman Chemical) | 9.0 |
| | Seesorb 705 (from Shiprokasei)*4 | 1.0 |
| | Methyl Ethyl Ketone | 40.0 |
| | Toluene | 40.0 |
| Comparative Example 2 | CAB-551-0.2 (from Eastman Chemical) | 9.0 |
| | Tinuvin 320 (from Ciba-Geigy Japan)*5 | 1.0 |
| | Methyl Ethyl Ketone | 40.0 |
| | Toluene | 40.0 |

Notes to Table 1:
*1: Cellulose acetate butyrate resin
*2: UV absorbent liquid at normal temperature
*3: UV absorbent liquid at normal temperature
*4: UV absorbent solid at normal temperature
*5: UV absorbent solid at normal temperature Next, as in Table 2, an adhesive layer composition was applied onto the thus-formed release layer for a thermal transfer laminate layer, in an amount to give a dry thickness of 1 $\mu$m, and dried (at 120° C. for 1 minute) thereby forming thereon an adhesive layer. The release layer and the adhesive layer thus formed in the manner noted above constitute a thermal transfer laminate layer. In that manner, herein produced were various transfer-type laminate films.

TABLE 2

| Constituent Components | Amount (wt. pts.) |
|---|---|
| CAB-551-0.2 (from Eastman Chemical) | 20.0 |
| Methyl Ethyl Ketone | 40.0 |
| Toluene | 40.0 |

Evaluation

The transfer-type laminate films produced in Examples 1 to 4 and Comparative Examples 1 and 2 were tested and evaluated for their influence on printed images, according to the method mentioned below.

Evaluation of Laminate Films for UV Absorbent Precipitation

Using a printer, each laminate film was applied onto printed images and was evaluated for the presence or absence of UV absorbent precipitation in the transferred laminate layer. Concretely, using a Sony's UP-D7000 printer, Sony's UPC-7041 printing paper was printed to have a solid black pattern, which was coated with any of the transfer-type laminate films produced in Examples and Comparative Examples. The thus-coated prints were left in a room, and their surfaces were checked with a microscope for the presence or absence of UV absorbent precipitation therein. The quality of the prints was evaluated according to the following evaluation criteria. The test results are shown in Table 3.

Evaluation Criteria for UV Absorbent Precipitation

Rank Condition of Print Surface

O: No precipitation found.

X: Precipitation found.

TABLE 3

| | UV Absorbent Precipitation |
|---|---|
| Example 1 | O |
| Example 2 | O |
| Example 3 | O |
| Example 4 | O |
| Comparative Example 1 | X |
| Comparative Example 2 | X |

From the data in Table 3, it is known that no UV absorbent precipitated in the films of Examples 1 to 4 having been transferred onto the printed patterns. This means that the laminate films of Examples 1 to 4 have no negative influence on the printed patterns.

As opposed to those, it is known that the UV absorbent precipitated in the films of Comparative Examples 1 and 2 having been transferred onto the printed patterns. This means that the laminate films of Comparative Examples 1 and 2 have some negative influences on the printed patterns.

From the test results as above, it is understood that, as compared with the ultraviolet absorbents that are solid at normal temperature, a larger amount of the ultraviolet absorbents that are liquid at normal temperature could be added to the thermal transfer laminate layer without having any negative influence on the printed images coated with the layer.

Even when a large amount of an ultraviolet absorbent is added to the thermal transfer laminate layer of the transfer-type laminate film of the invention so as to increase the resistance to light of the images printed on printing paper and coated with the laminate layer, the ultraviolet absorbent is prevented from precipitating in the laminate layer as transferred onto the printed images, and therefore, the quality of the images as coated with the laminate layer is not degraded. Accordingly, the resistance to light of the images coated with the laminate layer from the transfer-type laminate film of the invention is improved.

What is claimed is:

1. A transfer-type laminate film comprising a thermal transfer laminate layer for image protection as formed on a substrate, wherein the thermal transfer laminate layer contains an ultraviolet absorbent that is liquid at ordinary temperature.

2. The transfer-type laminate film as claimed in claim 1, wherein the thermal transfer laminate layer is composed of a release layer and an adhesive layer formed on the substrate in that order, and at least one of the release layer and the adhesive layer contains the liquid ultraviolet absorbent.

3. The transfer-type laminate film as claimed in claim 1, wherein the thermal transfer laminate layer is composed of an adhesive layer and a re-transfer preventing layer formed on the substrate in that order, and at least one of the adhesive layer and the re-transfer preventing layer contains the liquid ultraviolet absorbent.

4. The transfer-type laminate film as claimed in claim 1, wherein the thermal transfer laminate layer is composed of, a release layer, an adhesive layer and a re-transfer preventing layer formed on the substrate in that order, and at least one of the release layer, the adhesive layer and the re-transfer preventing layer contains the liquid ultraviolet absorbent.

5. A thermal transfer ink sheet comprising a subliming dye-containing ink layer and a thermal transfer laminate layer for image protection as formed on one and the same surface of a substrate, wherein the thermal transfer laminate layer contains an ultraviolet absorbent that is liquid at ordinary temperature.

6. The thermal transfer ink sheet as claimed in claim 5, wherein the thermal transfer laminate layer is composed of a release layer and an adhesive layer formed on the substrate in that order, and at least one of the release layer and the adhesive layer contains the liquid ultraviolet absorbent.

7. The thermal transfer ink sheet as claimed in claim 5, wherein the thermal transfer laminate layer is composed of an adhesive layer and a re-transfer preventing layer formed on the substrate in that order, and at least one of the adhesive layer and the re-transfer preventing layer contains the liquid ultraviolet absorbent.

8. The thermal transfer ink sheet as claimed in claim 5, wherein the thermal transfer laminate layer is composed of, a release layer, an adhesive layer and a re-transfer preventing layer formed on the substrate in that order, and at least one of the release layer, the adhesive layer and the re-transfer preventing layer contains the liquid ultraviolet absorbent.

* * * * *